US005109560A

United States Patent [19]

Uetake

[11] Patent Number: 5,109,560

[45] Date of Patent: May 5, 1992

[54] VENTILATED AIR MATTRESS WITH ALTERNATELY INFLATABLE AIR CELLS HAVING COMMUNICATING UPPER AND LOWER AIR CHAMBERS

[75] Inventor: Tsuyoshi Uetake, Tokyo, Japan

[73] Assignee: Keisei Medical Industrial Co., Ltd., Tokyo, Japan

[21] Appl. No.: 762,867

[22] Filed: Sep. 18, 1991

[51] Int. Cl.[5] ..... A61G 7/057; A47C 27/10; A47C 21/04

[52] U.S. Cl. ..... 5/453; 5/455; 5/469; 5/914

[58] Field of Search ..... 5/453, 455, 456, 469, 5/449, 457. 458; 297/DIG. 3

[56] References Cited

U.S. PATENT DOCUMENTS

| | | | |
|---|---|---|---|
| 2,782,834 | 2/1957 | Vigo . | |
| 3,008,465 | 11/1961 | Gal | 5/453 |
| 3,266,064 | 8/1966 | Figman | 5/468 |
| 3,486,177 | 12/1969 | Marshack | 5/468 |
| 3,681,797 | 8/1972 | Messner | 5/455 |
| 3,740,777 | 6/1973 | Dee | 5/469 |
| 3,757,366 | 9/1973 | Sacher | 5/469 |
| 3,909,858 | 10/1975 | Ducker | 5/453 |
| 4,305,168 | 12/1981 | Holter et al. | 5/469 |
| 4,391,009 | 7/1983 | Schild et al. | 5/453 |
| 4,488,322 | 12/1984 | Hunt et al. | 5/453 |
| 4,525,885 | 7/1985 | Hunt et al. | 5/453 |
| 4,638,519 | 1/1987 | Hess | 5/453 |
| 4,686,722 | 8/1987 | Swart | 5/453 |
| 4,777,679 | 10/1988 | De Looper | 5/455 |
| 4,829,616 | 5/1989 | Walker | 5/453 |
| 4,864,671 | 9/1989 | Evans | 5/469 |
| 4,890,344 | 1/1990 | Walker | 5/453 |
| 4,935,968 | 6/1990 | Hunt et al. | 5/453 |

FOREIGN PATENT DOCUMENTS

| | | | |
|---|---|---|---|
| 3114892 | 2/1982 | Fed. Rep. of Germany | 5/455 |
| 2177595 | 1/1987 | United Kingdom | 5/453 |
| 2197192 | 5/1988 | United Kingdom | 5/455 |
| 8908439 | 9/1989 | World Int. Prop. O. | 5/455 |

*Primary Examiner*—Alexander Grosz
*Attorney, Agent, or Firm*—Price, Heneveld, Cooper, DeWitt & Litton

[57] ABSTRACT

An air mattress is provided having an improved internal construction for supporting a patient. The mattress provides an internal ventilation system for controlling environmental conditions present at the patient mattress interface. The air mattress contains a plurality of pneumatic envelopes disposed adjacent each other. Located between the envelopes are ventilation conduits having a plurality of exhaust ports. Sequentially alternating envelopes are coupled to a fluid supply line which in turn is coupled to a source of compressed air. At predetermined intervals, a first set of envelopes is inflated while adjacent envelopes are deflated, and vice versa, shifting support for the patient to different areas of the body. Each envelope has two vertically disposed chambers. These preferably are provided lateral support by upright, lateral elastic members straddling the envelope. Ventilating air may be provided by an air conditioning system to a manifold for distribution to the several ventilation conduits. In this manner, pressure points along the patient's body are periodically relieved while simultaneously receiving conditioned air to comfort the patient.

10 Claims, 4 Drawing Sheets

VENTILATED AIR MATTRESS WITH ALTERNATELY INFLATABLE AIR CELLS HAVING COMMUNICATING UPPER AND LOWER AIR CHAMBERS

BACKGROUND OF THE INVENTION

This invention relates to support appliances, and particularly to a mattress for patients confined to bed for protracted periods.

Persons confined to bed for protracted periods often develop decubitus ulcers or bed sores in areas of the body in continuous contact with the bedding surface. Moisture, elevated body temperature, and poor ventilation are associated with the development of such disorders. Those in the medical industry have attempted to treat decubitus ulcers by providing specialized bedding designed to relieve the source of the pressure, reduce the temperature, or remove the moisture. Such developments in bedding have also found application in the treatment of burn patients who are confined to bed for protracted periods.

In an effort to treat seriously burned patients and those susceptible to developing decubitus ulcers, mattresses have been developed which contain a plurality of discrete air cells or envelopes. Alternate rows of the cells are inflatable and deflatable to redistribute support points along the patient's body. Disadvantages associated with such mattresses include lateral movement or shifting of the cells to those points previously supported by the now deflated cells. The net effect is that pressure, temperature, and moisture have not been reduced at the affected area.

SUMMARY OF THE INVENTION

A mattress is provided having a plurality of specially configured, discreet elongated cells or envelopes packed within a mattress cover. The cells are adjacent each other and arranged so that a longitudinal axis of each is horizontal and perpendicular to the longitudinal axis, i.e., longer dimensions, of the mattress. Each of the plurality of envelopes is formed of upper and lower chambers. Between the cells are side support plates to further stabilize the cells. Adjacent the side support plates are perforated elongated ventilation air conduits. The cells are coupled to a fluid supply line so that certain envelopes are inflated while alternate envelopes are deflated, and vice versa. The alternating sequence of inflating and deflating envelopes redistributes support points for the patient. Interleaved with the envelopes is the ventilation system comprised of the plurality of perforated conduits, each conduit having a plurality of ports. The many conduits are coupled to a manifold within the mattress cover, which in turn is coupled to a means for controlling the temperature and moisture content of air supplied through the ventilation system.

BRIEF DESCRIPTION OF THE DRAWINGS

The features and benefits of the present invention will be more apparent from the following description of preferred embodiments made in reference with the accompany drawing figures, wherein.

DETAILED DESCRIPTION OF THE PREFERRED EMBODIMENTS

Figure 1:
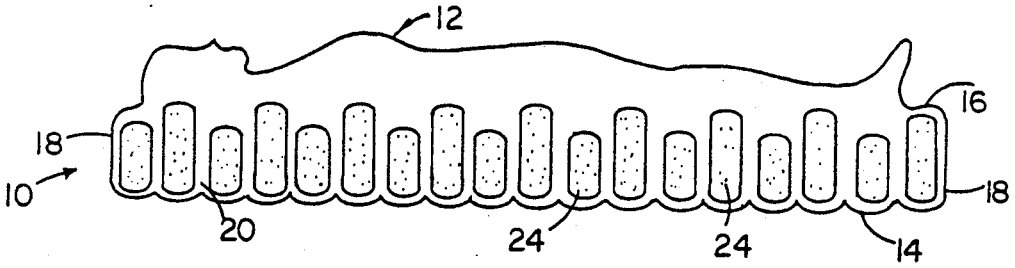
FIG. 1 is a partially schematic, side elevational view of a mattress supporting a patient as contemplated by the invention.

FIG. 1 is a general side elevational view of a mattress 10 supporting a patient 12 as contemplated by the instant invention. The mattress may be supported above the floor by a conventional bed frame such as is used in the medical industry. The mattress is shown enclosed by a cover 22 having an upper and a lower surface 14 and 16, respectively, interconnected by end walls 18 and sidewalls 20. The mattress cover 22 may be constructed from a number of materials available in the industry, although it is preferred that the material selected be permeable to fluids.

The interior of the mattress contains a plurality of elongated envelopes or cells generally indicated as 24 and formed of a polymeric material. The cells, described in greater detail below, are packed adjacent to each other within the mattress and arranged so that a longitudinal axis of each is horizontal and perpendicular to the longitudinal axis of the mattress. Each cell 24 is filled with air to support the patient 12. Periodically, alternate envelopes are deflated while the adjacent envelopes are inflated, and vice versa, redistributing the support points along the patient's body.

Figure 2:
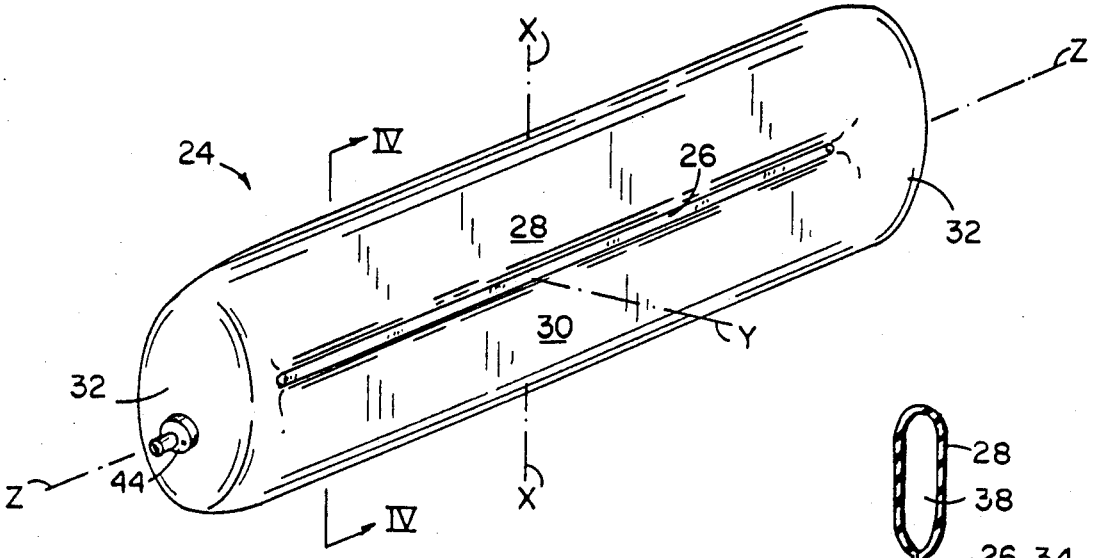
FIG. 2 is an oblique view of one envelope used in the mattress.
Figure 3:
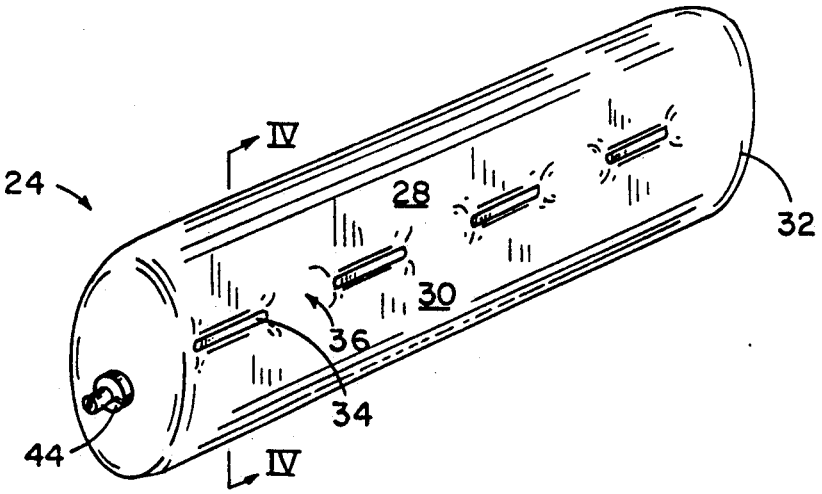
FIG. 3 is an oblique view of an alternate embodiment of the envelope shown in FIG. 2.

As seen in FIG. 2, the individual cell defines a generally rectangular volume, having a longitudinal axis "Z" corresponding to the length, a lesser vertical axis "X" corresponding with the height, and a width defined by the shortest axis "Y." The envelope 24 has a central depression or suture line 26 parallel to the longitudinal axis to form an upper chamber 28 and a lower chamber 30. The suture line 26 may be formed by laterally joining the two sidewalls of the cell along the line and sealing them together by applying heat. In one embodiment, the suture line stops short of each end, allowing air within cells 28 and 30 to flow therebetween through the end passages. FIG. 3 illustrates a different embodiment of the suture line 34 than that shown in FIG. 2. Suture 34 is intermittent along the length of the cell, allowing the two chambers 28 and 30 to communicate with each other by passages 36 transversing the suture. The chambers of each cell are in a vertically stacked relationship, with the total height of both chambers being about double the width thereof. The cells are preferably made from a thermoplastic polymer or synthetic sheet such as polyvinyl chloride or other material having similar flexible, elastic characteristics.

Figure 4:
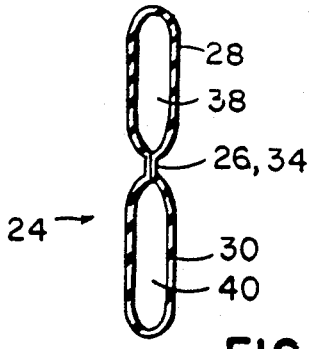
FIG. 4 is a cross section view of the envelope shown in FIG. 3, taken on plane IV—IV.

FIG. 4 is an elevational cross section taken along line IV shown in FIGS. 2 and 3. Illustrated are the upper and lower chambers 28 and 30 separated from each other by the suture 26 or 34 created by joining the two sides together. The envelope is shown in the relaxed or unloaded state wherein each chamber 28 and 30 has a distinctly vertically elongate cross section. The vertically elongate shape of each cell in the envelope is preferred so that, among other reasons, load will be directed toward the upper and lower sides.

Figure 5:
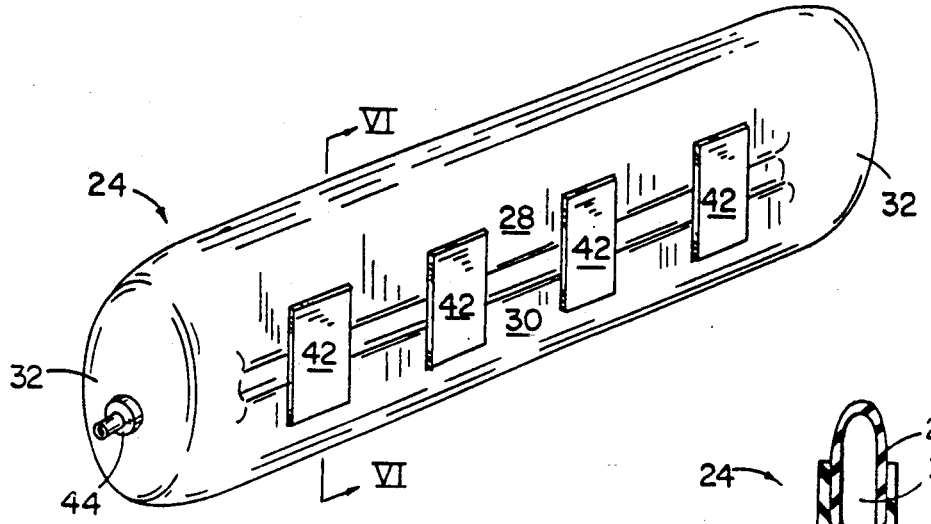
FIG. 5 is an oblique view of a preferred embodiment of a supported envelope used in the invention.
Figure 6:
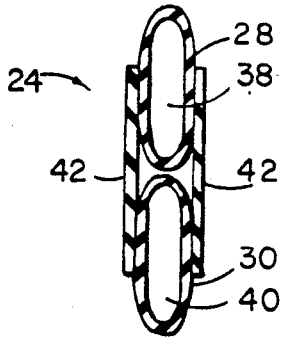
FIG. 6 is a cross section taken through the envelope shown in FIG. 5, taken on plane VI—VI.

FIGS. 5 and 6 illustrate a preferred embodiment of the envelope constructed from a single flexible polymeric tube. FIG. 5 is an oblique view of a preferred embodiment of an envelope used in the invention. FIG. 6 is a cross section taken through the envelope shown in FIG. 5. The circular tube is compressed to an oblate shape with a substantial portion of each tube parallel to the other. As in the previous embodiment, in the relaxed state, each cell has a generally elongate cross section. The weight of the patient compresses each elongated chamber into a generally spherical cross section, thus supporting the patient along a substantially horizontal surface tangential to the upper chambers.

Shown connected to the outside of envelope 24 and interconnecting upper and lower chambers 28 and 30 are upright, lateral, parallel supports 42. Each is comprised of a strip of elastic, polymeric plate material disposed at predetermined intervals along the exterior and interconnecting the walls of the two chambers. Each of the supports is attached to the envelope using conventional adhesives or, alternatively, by the application of heat to thermoplastically bond it in place.

Located at an end of each of the envelopes or cells 24 (shown in FIGS. 2-6) is a nipple 44 adapted to be coupled to a fluid supply line, to be described below. Nipple 44 may be constructed from the same material as the envelope, encasing a suitable connector for the fluid supply line.

Figure 7:
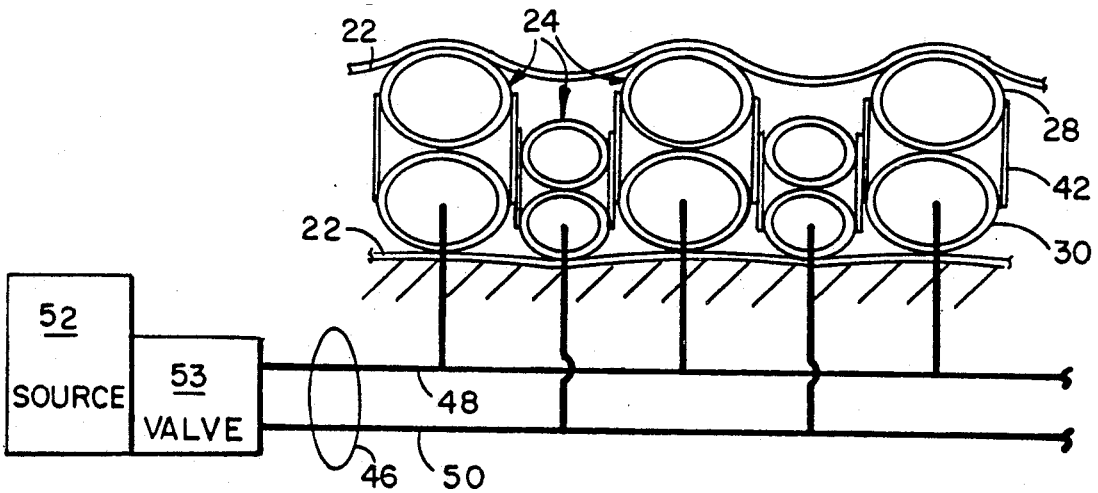
FIG. 7 is a side elevational view of a portion of the mattress shown in FIG. 1.

FIG. 7 is a side elevational view of a section of the mattress shown in FIG. 1. Mattress 10 contains a plurality of the envelopes 24 disposed adjacent to each other and enclosed by covering 22 to form upper and lower surfaces, 14 and 16. As schematically illustrated in the figure, each envelope may be coupled to a fluid supply bundle 46 providing a plurality of lines such as shown by numerals 48 and 50, each line coupled to sequentially alternating envelopes. The opposite end of each line 48 and 50 may be interconnected to a source 52 by a valve 53. Valve 53 directs fluid from source 52 to appropriate line 48 or 50, depending upon which alternate set of envelopes are being inflated. Simultaneously, valve 53 opens the appropriate line 48 or 50 to allow the fluid to escape from within the deflating set of envelopes.

Figure 8:
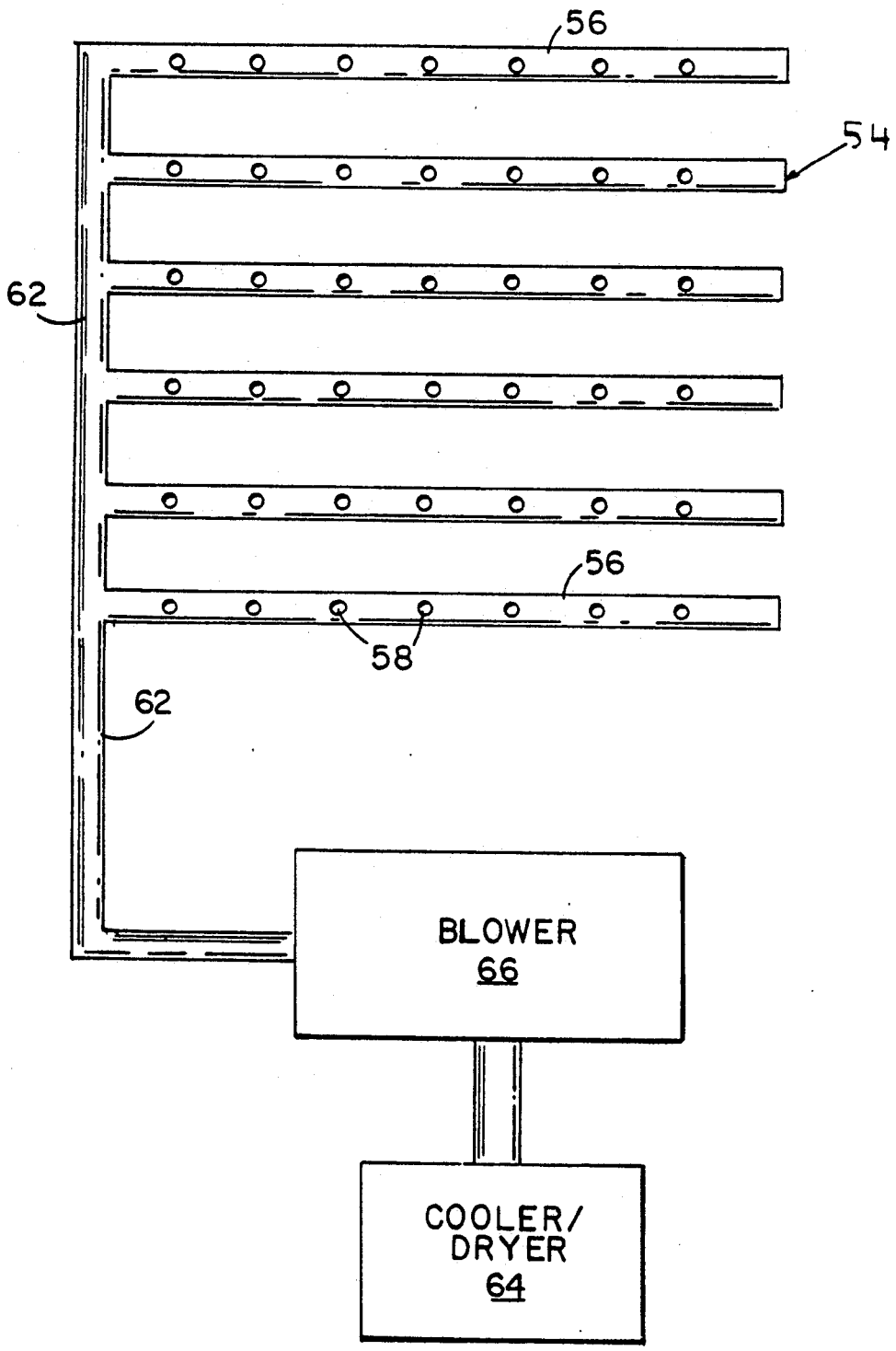
FIG. 8 is a diagram illustrating a ventilation system to be used in conjunction with the mattress of FIG. 1.

FIG. 8 is a diagram illustrating a ventilation system 54 to be used in conjunction with a mattress of FIG. 1. In general, ventilation system 54 is comprised of a plurality of elongated conduits 56, each perforated to have a plurality of discharge vent openings 58. Conduits 56 are located between the cells, but below the tops of the cells so as to not contact the patient. One end 60 of each conduit is capped or plugged with its second end coupled to a manifold 62. The manifold, in turn, is coupled to an air cooler/dryer 64 driven by a pump or blower 66. Means for controlling the temperature of the air provided through the system may be contained within the cooler/dryer. The moisture content of the air may also be controlled by the conditioning of the air in the cooler/dryer.

Figure 9:
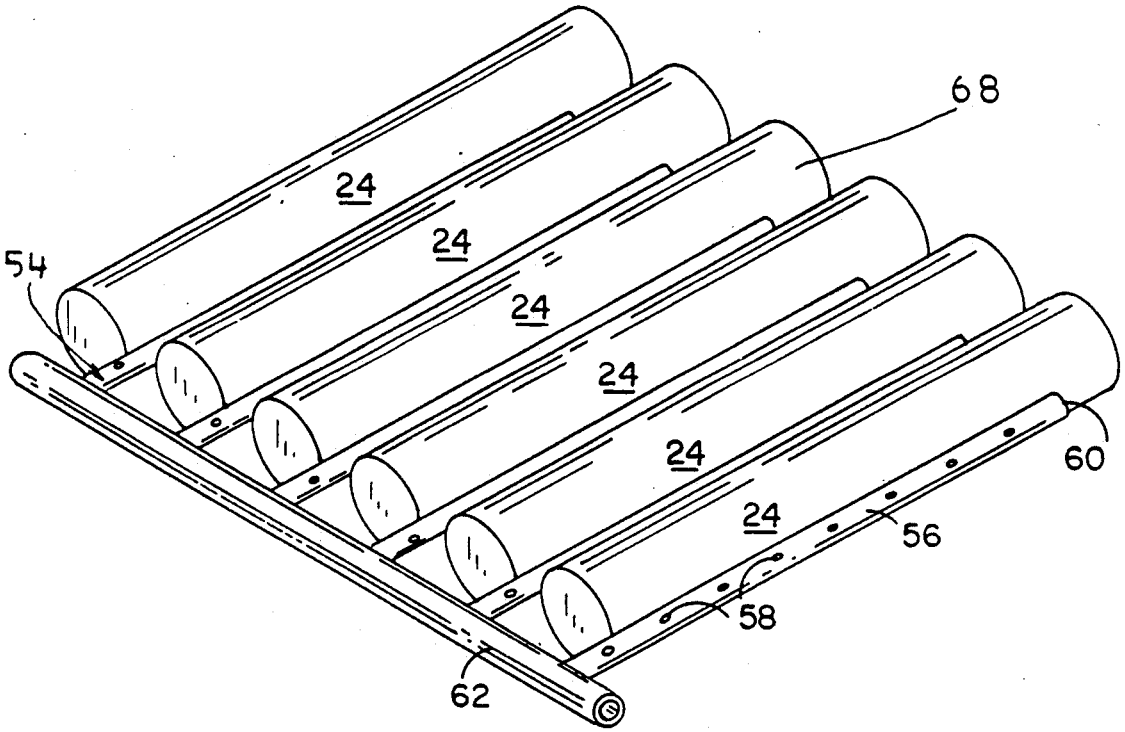
FIG. 9 is an oblique view illustrating the spatial relationship between the envelopes and the ventilation systems.

FIG. 9 is an oblique view illustrating the spatial relationship of ventilation system 54 between envelopes 24. In this figure, each envelope is shown in a generic form as represented by cylinders 68. Each of vent pipes 56 may be centrally disposed between adjacent envelopes 68 with the manifold 62 extending along a margin of the mattress. In a preferred embodiment, vent holes 58 are oriented vertically toward the upper and lower surfaces 16 and 14 of the mattress. To prevent the vent holes 58 from being sealed by the envelopes, each vent hole 58 is recessed within an annular groove 70 about pipe 56, shown in greater detail in FIG. 10.

Figure 10:
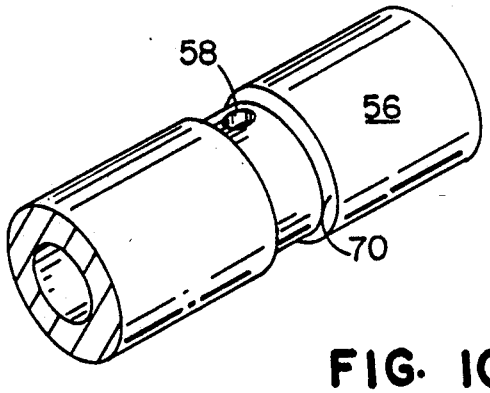
FIG. 10 is an enlarged view of a portion of a pipe detailing an exhaust port.

FIG. 10 is an enlarged view of a portion of a pipe 56 detailing a vent hole 58 in groove 70. In this embodiment, if an envelope 24 were to cover pipe 56, air would pass through hole 58 and would pass through annular groove 70 and out through covering 22.

In operation, patient 12 is supported by a first set of air-filled envelopes 24 located within mattress 12. The envelopes 24 supporting the patient are adjacent to and alternate to a second set of envelopes 24 which are partially evacuated or deflated. At predetermined intervals, fluid supply lines 48 and 50 within bundle 46 provide air to the evacuated envelopes while simultaneously evacuating the alternate inflated envelopes so that every other envelope supports the patient's body. The sequencing of inflation and deflation of the plurality of envelopes is controlled by the valve interconnecting supply bundle 46 to compressor 52. As each set of the envelopes inflates and deflates, the vertical orientation of cells is maintained by lateral supports 42. In addition, added support is provided by mattress cover 22 as well as the deflating, adjacent envelopes. Although not shown, the envelopes may be interconnected to each other by way of snaps or belts which also assist in maintaining the vertical orientation of the envelopes.

Simultaneously with the alternating support points for the patient, the temperature and moisture content of the mattress at the interface with the patient's body are being controlled. Conditioned air provided by cooler/dryer 64 is passed through manifold 62 and distributed to each of vent pipes 56 and is forced out through each of the plurality of vent holes 58. The conditioned air between the envelopes ventilates the covering of the mattress, eventually felt by the patient positioned immediately above. As noted, the vent pipes are located deep enough within the mattress to avoid contact with the patient.

Though the invention has been described with respect to specific preferred embodiments thereof, many variations and modifications will become apparent to those skilled in the art. It is therefore the intention that the appended claims be interpreted as broadly as possible in view of the prior art to include all such variations and modifications within the scope of the claims or which are equivalent structures to that defined.

I claim:

1. A mattress comprising:

a plurality of elongate, fluid-filled cells adjacent to each other, having lateral surfaces, upper and lower surfaces, said upper surfaces collectively forming a support surface, each of said plurality of fluid-filled cells having upper and lower chambers in fluid communication with each other;

means attached to said lateral surfaces of said cells interconnecting said upper and lower chambers to provide lateral support thereto;

said means for providing lateral support comprising chamber straddling upright members connecting the sidewalls of said upper and lower chambers;

means for inflating and deflating every other of said plurality of fluid-filled cells alternately as a function of time to define said support surface; and means adjacent said plurality of fluid-filled cells for ventilating said surface.

2. The mattress as recited in claim 1, wherein said upper and lower chambers are provided by connecting said sidewalls together between said chambers whereby said chambers are in a stacked relationship.

3. The mattress as recited in claim 1, including:

means between said plurality of fluid-filled cells for providing ventilation to said supporting surface.

4. The mattress as recited in claim 1, wherein said cells are of polymeric material and have sidewalls and chambers defined by said sidewalls on opposite sides of individual being joined together.

5. The mattress as recited in claim 1, wherein said means for inflating and deflating alternate ones of said plurality of cells, comprises:

a fluid source;

valve means coupled to said fluid source; and at least two lines interconnecting alternate ones of said plurality of cells to said valve means.

6. The mattress as defined in claim 1, wherein said means for ventilating said surface comprises:

an air blower;

means in fluid communication with said air blower and disposed between said plurality of cells for exhausting the air from said blower within said mattress, said air allowed to percolate out of the mattress through a cover.

7. The mattress as recited in claim 6, further comprising means coupled to said air blower for conditioning the air, including means for controlling air temperature.

8. The mattress as recited in claim 1, wherein said cells have a vertical dimension about twice the width thereof.

9. The mattress as recited in claim 1, wherein said means for providing ventilation comprises a plurality of orificed conduits located between said cells.

10. The mattress as recited in claim 1, wherein said means for ventilating said mattress cover comprises:

an air blower;

means in fluid communication with said air blower and disposed between said plurality of cells for exhausting the air from said blower within said mattress, said air allowed to percolate out of the mattress through a cover.

* * * * *